United States Patent [19]

Lawson

[11] Patent Number: 5,044,791

[45] Date of Patent: Sep. 3, 1991

[54] IMPRESSION TOOL

[76] Inventor: J. Alan Lawson, 205 Old Plank Rd., Courtland, Va. 23837

[21] Appl. No.: 380,317

[22] Filed: Jul. 17, 1989

[51] Int. Cl.[5] ..... B41J 1/54

[52] U.S. Cl. ..... 400/134.4; 400/134; 101/3.1; 101/4; 101/32

[58] Field of Search ..... 101/4, 3.1, 32; 72/409, 72/410; 29/751; 400/134.4, 134.5, 134.6, 134

[56] References Cited

U.S. PATENT DOCUMENTS

| | | | |
|---|---|---|---|
| 2,275,670 | 3/1942 | Zipf | 400/134.5 |
| 2,925,625 | 2/1960 | Souza | 400/134.5 |
| 3,381,789 | 5/1968 | Hawes | 400/134.4 |
| 3,901,370 | 8/1975 | Poulton | 400/134.4 |
| 4,126,936 | 11/1978 | Koller | 101/4 |
| 4,339,209 | 7/1982 | Tanigami | 400/134.5 |

*Primary Examiner*—David A. Wiecking
*Assistant Examiner*—Joseph R. Keating
*Attorney, Agent, or Firm*—Staas & Halsey

[57] ABSTRACT

An impression tool has a marker head supported on one handle and an anvil supported on another anvil, the two handles being pivotally connected near the ends supporting the marker head and anvil. A pressure sensitive label is received on the anvil and is impressed by the marker head when the handles are manipulated to being the marker head and anvil together. The marker head is made of a plurality of rotatable disks, each of which has a plurality of print characters formed on the outer circumferential surface thereof.

2 Claims, 2 Drawing Sheets

IMPRESSION TOOL

BACKGROUND OF THE INVENTION

1. Field of the Invention

The present invention relates generally to the field of labelling and, more specifically, to an impression tool for manually marking tubular labels for wire coding.

2. Description of the Related Art

In certain industrial applications, it becomes necessary to mark and identify electrical control wires. For example, a number of wires from a field device may lead to a central computer or central control station and those wires at the terminal end portions must be identified according to a drawing. Thus, the drawing number or line number per drawing will carry the wire number so there is a relationship between the field wiring and the system drawings. This will enable trouble shooting in the future.

Typically, wires are marked with a sleeve-type label such as a shrink-fit tubing which is cut into small (typically 1-inch) lengths and is split axially to fit the wire size or the insulation size of the wire. The individual segments are marked by a heat typing typewriter. This type of typing is called thermal printing, whereby an operator is required to type each one of the wire numbers onto each tubular label. The heat burns the plastic black or it can be burned with an ink material to fill in the hole where burnt. These tubular labels or markers are then taken out into the field and the electrician slides each one over the respective wire. If heat shrinking is required, the electrician then applies a heat gun and thus shrinks the diameter of the wire marker down to the diameter of the wire.

The heat typing and heat shrinking processes described above are generally slow and relatively expensive. Moreover, there is a distinct disadvantage in that the typewriters cannot be taken into the field or in a rough control room where there may not be electricity.

Since the wires may come into contact with oils, acids, bases, or other chemicals, wire markers which use ink may become blurred since ink is easily dissolvable. Thus, it would be advantageous to avoid using ink when labelling wires.

A need exists for a wire marker which is simple in construction and easily to use, and avoids using exposed ink (that which is on the outer surface of a label) or thermal typing.

SUMMARY OF THE INVENTION

An object of the present invention is to provide an impression tool for manually marking tubular labels for wire coding.

Another object of the present invention is to provide an impression tool which can be operated in the field without electricity.

Another object of the present invention is to provide an impression tool which facilitates marking labels and applying them to wires in the field.

These and other objects of the invention are provided by an impression tool for marking a label, including a marker head having a plurality of print characters formed on an outer surface thereof, an anvil movable relative to the marker head and supporting a label to be marked, and means for moving the marker head and the anvil together with the label to be marked therebetween so that at least one of the plurality of print characters is impressed upon the label. Preferably, the marker head includes a plurality of concentric rotatable disks, each having an outer circumferential surface on which the plurality of print-characters are formed. The rotatable disks are supported on a carrier shaft which is mounted in a clevis formed on one end of a first handle. A corresponding end of a second handle carries the anvil, and the two handles are pivotally connected near the corresponding ends to form the moving means.

Another aspect of the present invention is to provide a method of marking a wire including forming a label out of pressure sensitive material, rotating a marker head having a plurality of print characters until a predetermined combination of print characters are aligned, placing the label on an anvil, moving the marker head and the anvil together with the label to be marked therebetween thereby impressing the combination of print characters upon the label, and attaching the label to the wire.

The foregoing and other features and advantages of the impression tool in accordance with the present invention will become more apparent from the following detailed descriptions, taken in conjunction with the drawings.

DETAILED DESCRIPTION OF THE PREFERRED EMBODIMENTS

Figure 1:
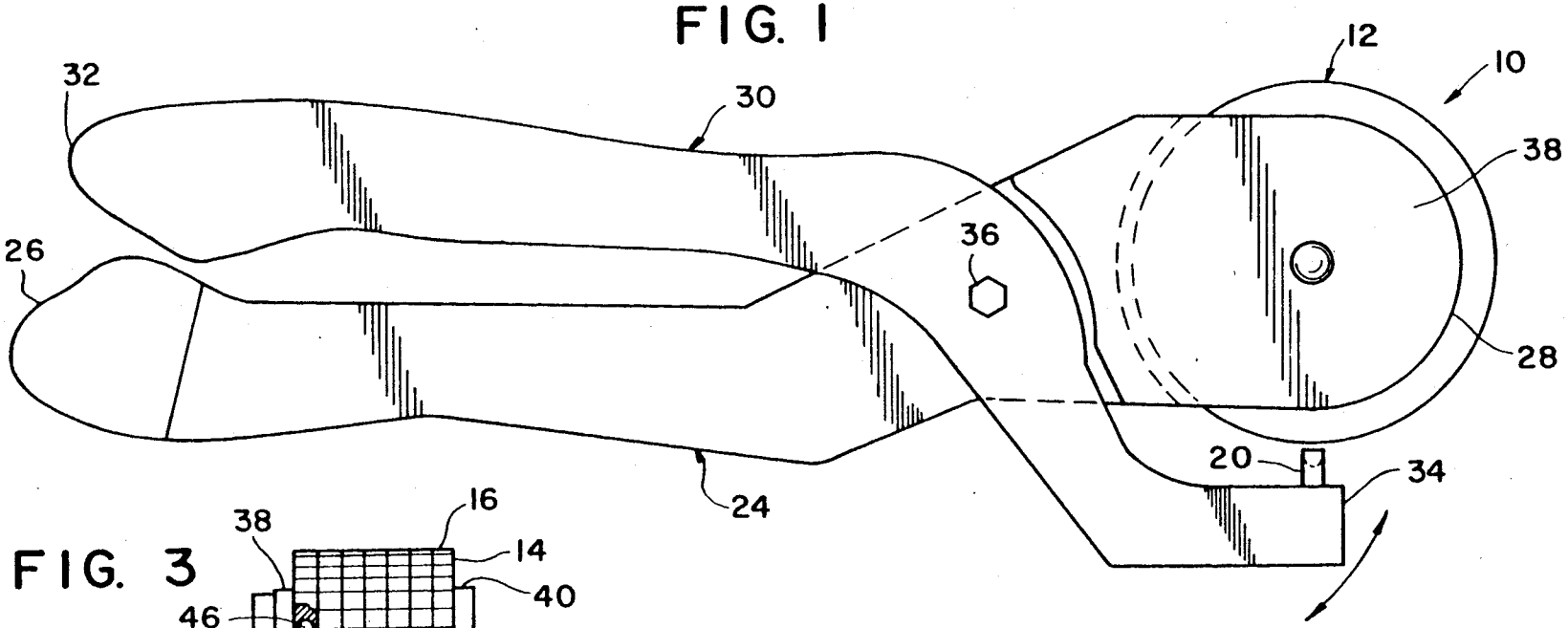
FIG. 1 is a side elevational view of the impression tool according to the present invention.
Figure 2:
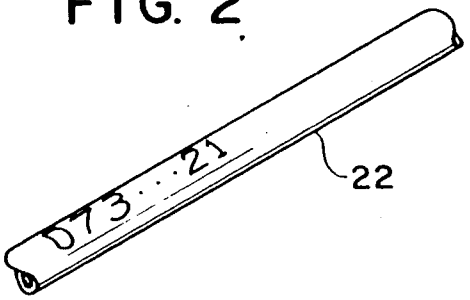
FIG. 2 is a perspective view of a tubular label used in the impression tool of FIG. 1.
Figure 3:
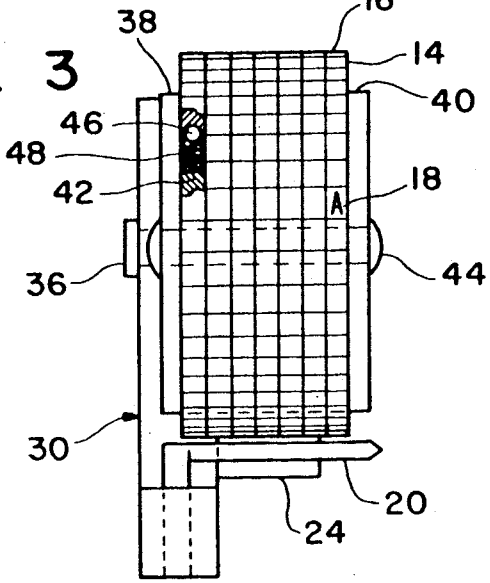
FIG. 3 is a front elevational view of the impression tool of FIG. 1.
Figure 4:
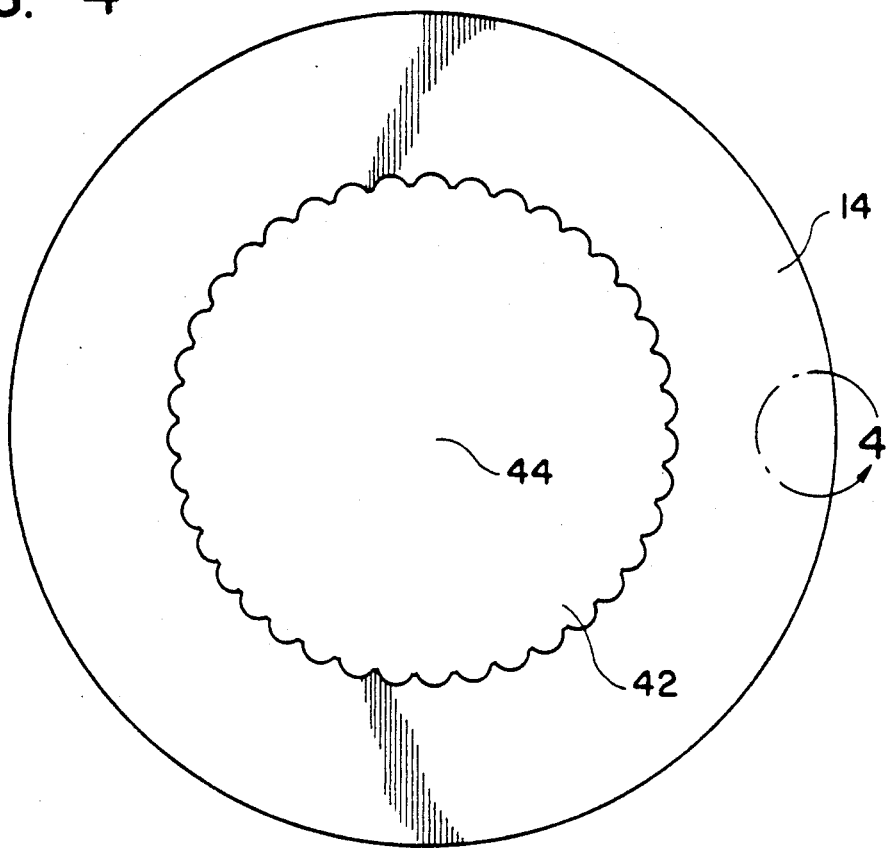
FIG. 4 is a side elevational view of one of the disks which form the marker head of the impression tool illustrated in FIG. 1.
Figure 5:
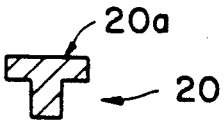
FIGS. 5–8 are cross-sectional views showing various cross-sectional shapes which may be used for the anvil portion of the impression tool illustrated in FIG. 1.
Figure 4A:
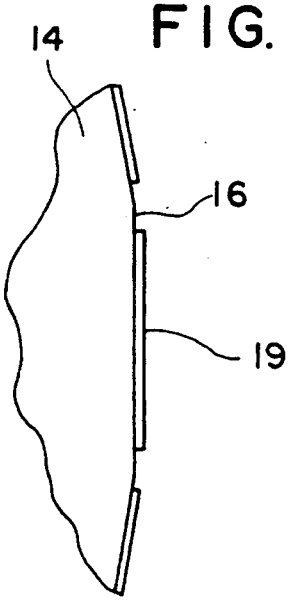
FIG. 4*a* is an enlarged view of a portion of FIG. 3, designated by the circle 4.
Figure 6:
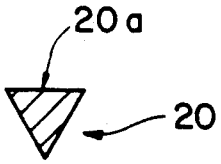
Figure 7:
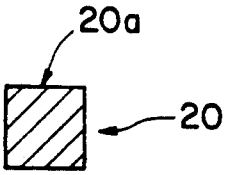

Referring now to FIGS. 1–3, an impression tool is generally referred to by the numeral 10 and includes a marker head 12 having a plurality of print characters formed on an outer surface thereof. The marker head 12 is an assembly of concentric rotatable disks 14, each having an outer circumferential surface 16 on which a plurality of print characters 18 are formed. The print characters are the letters A–Z and number 0–9, as well as plus, minus, slash symbols and blanks. Each circumferential surface is defined by 39 flat surfaces on the disks 14, with each character being formed on one of the flat surfaces. A better illustration of the foregoing can be found in FIG. 4*a*. Thus, each disk 14 includes all of the letters of the alphabet and all numbers. Preferably, there are seven disks 14 and thus a myriad of seven digit number letter combinations can be selected by rotating individual disks to align a predetermined combination.

An anvil 20 is movable relative to the marker head 12 and is capable of supporting a label to be marked. The anvil is particularly adapted for receiving a tubular or sleeve label 22 by sliding the anvil into the sleeve. The sleeve 22 is made of a pressure sensitive material such that when the material is impressed, a color change takes place at the point of impression. Pressure sensitive materials are generally known and available through the 3M Corporation of St. Paul, Minn., and National Cash Register (of Dayton, Ohio), for example. Preferably, the pressure sensitive material is of the type having micro-encapsulated material which ruptures when impressed by a print character. The micro-encapsulated material is preferably an etchant which burns into a layer covering the etchant, thereby burning a dark color into the covering from beneath. Other micro-encapsulated material, such as a colorant material, or two different materials which produce a color when mixed together by rupturing, may be used. The sleeve labels may be formed from sheets of pressure sensitive material in which longitudinal edges are adhered to thereby forming the sleeve. Micro-encapsulated material is also referred to as "carbonless printing".

Means are provided for moving the marker head 12 and the anvil 20 together with the label 22 to be marked therebetween so that a combination of print characters is impressed upon the label. Preferably, the moving means includes a first handle 24 having two opposite ends 26 and 28, and supporting the marker head 12 at the end 28. A second handle 30 has opposite ends 32 and 34, and is pivotally connected to the first handle 24 at the pivot pin 36. The end 34 of the second handle 30 supports the anvil 20 in a cantilevered position such that an opposing surface of the anvil 20 is substantially parallel to an opposing surface of the marker head 12.

Figure 8:
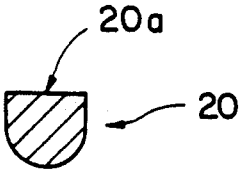

The two handles 24 and 30 may be made of rigid plastic material, and the anvil is preferably made of steel. FIGS. 5–8 illustrate various embodiments of the anvil having crosssectional shapes including a T-shape (FIG. 5), a triangle shape (FIG. 6), a square shape (FIG. 7), and a D-shape (FIG. 8). In each of the embodiments, an upper surface 20*a* of the anvil is substantially flat to ensure that the entire print character is impressed upon the label.

The end 28 of the first handle 24 has a clevis formed either integrally with the first handle or attached separately. The clevis includes two parallel, spaced apart arms 38 and 40 which support the marker head 12 therebetween on a carrier shaft 42 which is supported by a pin 44 extending between the arms 38 and 40 of the clevis. Each rotatable disk 14 turns on the carrier shaft 42, the outer cylindrical surface of which provides a barring surface for the disks.

Referring to FIG. 3, the carrier shaft 42 and pin 44 remains stationary between the arms of the clevis, while the rotatable disk 14 rotates thereon. An electrician or other field technician can rotate each of the disks 14 until a plurality of print characters aligned in a predetermined combination at a lower most point of the marker head. After rotating the disks as required, a label is then placed on the anvil and the marker head and anvil are moved together with the label to be marked therebetween by manipulating the handles similar to a pair of pierce or a crimping tool. The label is thus impressed so that the combination of print characters impinges upon the pressure sensitive material of the label to thereby marked the label as shown in FIG. 2.

The marker head 12 is provided with means for releasably locking each of the plurality of disks 14 to the carrier shaft 42. As shown in FIG. 3, a ball detent 46 is spring biased by a compression spring 48 into engagement with one of a plurality of recesses formed on an inner circumferential surface of each disk (see FIG. 4). The ball detent 46 provides resistance to rotation of the disk and thereby holds the same in position for printing. However, the position can be changed by rotating the disk with sufficient force to overcome the spring force and interference between the recess and the ball detent 46.

In a preferred embodiment, the flat surface of the anvil is about 6/32 inch in width, and each print character is about ¼ inch in width so that the character is fully embraced by the anvil when pressed together. Each character is raised about 1.25 m.m. above the surface of the disk.

Each label has an adhesive backing preferably covered by a pull sheet of waxed material, although other suitable adhesive means may be employed.

It will be recognized by those of skill in the art that numerous modifications and additions may be made to the various structures disclosed herein and thus it is intended by the appended claims to encompass all such modifications which fall within the true spirit and scope of the invention.

We claim:

1. A method of marking a wire comprising:

forming label out of a sheet of pressure sensitive material by rolling the sheet into a sleeve having inner and outer surfaces, rotating a marker head having a plurality of print characters until a predetermined combination of print characters are aligned, sliding an anvil into the sleeve so as to support the sleeve thereon, moving the marker head and anvil together with the label to be marked therebetween to thereby press the combination of print characters against the outer surface of the sleeve; and attaching the label to the wire.

2. An impression tool for marking a label made of a sheet of pressure sensitive material rolled into a sleeve having an inner surface and an outer surface, comprising:

a marker head having a plurality of print characters formed on an outer surface thereof, an anvil, means mounting said anvil for movement relative to the marker head, said anvil being shaped so as to be insertable into and support the sleeve of pressure sensitive material; and means for moving the marker head and the anvil together with the label to be marked positioned about said anvil so at least one of the plurality of print characters is impressed on the label.

* * * * *